US005517814A

United States Patent [19]

Stahlecker

[11] Patent Number: 5,517,814

[45] Date of Patent: May 21, 1996

[54] SUPPORTING DISK FOR A SUPPORTING DISK BEARING ARRANGEMENT OF AN OPEN-END SPINNING ROTOR

[75] Inventor: Hans Stahlecker, Sussen, Germany

[73] Assignee: Fritz Stahlecker, Bad Ueberkingen, Germany

[21] Appl. No.: 318,120

[22] Filed: Oct. 5, 1994

[30] Foreign Application Priority Data

Oct. 14, 1993 [DE] Germany ..... 43 34 985.4

[51] Int. Cl.[6] ..... D01H 1/24; F16C 13/00

[52] U.S. Cl. ..... 57/406; 57/407; 384/549

[58] Field of Search ..... 57/406, 407, 103; 384/549

[56] References Cited

U.S. PATENT DOCUMENTS

| | | | |
|---|---|---|---|
| 3,394,324 | 6/1976 | Gassner et al. | 74/215 |
| 4,020,710 | 5/1977 | Gassner et al. | 74/206 |
| 4,676,673 | 6/1987 | Stahlecker et al. | 384/549 |
| 4,713,932 | 12/1987 | Zott | 57/406 |
| 4,892,422 | 1/1990 | Stahlecker | 384/549 |
| 4,893,946 | 1/1990 | Tesh et al. | 384/549 |
| 4,893,947 | 1/1990 | Hurley | 384/549 |
| 4,896,976 | 1/1990 | Stahlecker | 384/549 |
| 5,221,133 | 6/1993 | Braun et al. | 57/406 |
| 5,362,160 | 11/1994 | Braun et al. | 57/407 |
| 5,399,028 | 3/1995 | Raasch | 384/549 |

FOREIGN PATENT DOCUMENTS

| | | | |
|---|---|---|---|
| 4011632 | 10/1991 | Germany | 57/406 |
| 4136794 | 8/1993 | Germany . | |

*Primary Examiner*—William Stryjewski

*Attorney, Agent, or Firm*—Evenson McKeown Edwards & Lenahan

[57] ABSTRACT

A supporting disk for the supporting disk bearing arrangement of an open-end spinning rotor comprises a base body and a ring-shaped fitting, whose outer circumference serves as a bearing surface for a shaft of the open-end spinning rotor. The base body has a supporting ring, the fitting being joined to its outer circumference. The fitting and the supporting ring are each made of plastic. The modulus of elasticity of the plastic of the supporting ring is at least ten times that of the modulus of the plastic of the fitting.

15 Claims, 2 Drawing Sheets

SUPPORTING DISK FOR A SUPPORTING DISK BEARING ARRANGEMENT OF AN OPEN-END SPINNING ROTOR

BACKGROUND AND SUMMARY OF THE INVENTION

The invention relates to a supporting disk for a supporting disk bearing arrangement of an open-end spinning rotor, the supporting disk comprising a base body connected with a shaft, the base body comprising a supporting ring made of plastic, and also comprising a ring-shaped fitting made of plastic, the outer circumference of the fitting forming a bearing surface for a shaft of the open-end spinning rotor, the inner circumference of the fitting being joined to the outer circumference of the supporting ring.

The invention relates further to a process for the manufacture of a supporting disk for a supporting disk bearing arrangement of an open-end spinning rotor, the supporting disk containing a base body comprising a supporting ring made of plastic, and a ring-shaped fitting also made of plastic which is joined to the outer circumference of the supporting ring.

A supporting disk is known from German published patent 41 36 794 C2 which discloses a ring-shaped fitting made of elastomer material and a supporting ring made of plastic, which has a modulus of elasticity of between 7000 to 13000 MPa. Polycarbamide is the material suggested for the supporting ring, and for the fitting, elastomer polyurethane. Details of the modulus of elasticity of the material used for the fitting are not given in the above named printed publication.

It is an object of the invention to provide a supporting disk and a process for its manufacture which facilitate good operational reliability and cost-effective construction.

This object is achieved according to the invention in the case of the supporting disk in that the modulus of elasticity of the plastic material of the supporting ring is at least ten times the modulus of elasticity of the plastic material of the fitting.

In the case of the process for manufacturing according to the invention, the object is achieved in that the supporting ring and the fitting are each made in a separate first injection mould procedure, whereby the supporting ring and the fitting are fused together in a second injection mould procedure.

Due to the above-mentioned ratio between the moduli of elasticity, the requirements arising from a design for a supporting disk (sufficient rigidity to provide steady operation, sufficient flexibility to provide a good damping function in relation to the shaft) can be reconciled. The base body is rigid enough to guarantee a steady running without fluttering. The fitting is elastic enough to effectively take the impact of the shaft of the open-end spinning rotor, but rigid enough to avoid any excessive flexing work. Despite the low manufacturing costs of the supporting disks, which are largely made of plastic, a good operational function and damping effect are thus maintained.

Under the modulus of elasticity within the invention being presented is understood the interrelationship between the increase of tension and the increase in extension of a rod during unhindered cross sectional deforming under tensile load (DIN 53 457).

In an advantageous development, thermoplastics with differing chemical structures are used for the supporting ring and fitting. Thermoplastics are easy to process and facilitate a cost-effective production.

In another advantageous development, a duroplastic is used for the supporting ring. Duroplastics are also easy to use, for example in a two-component injection-molding process. A thermoplastic or another easily processed plastic could be used for the fitting.

It is advantageous to use plastics capable of being injection molded for the supporting ring and/or the fitting. Thermoplastics in particular come under consideration; they are very suitable for a simple injection-molding process.

In an advantageous development, the supporting ring and the fitting are joined together by frictional connection. A supporting disk with a high operational reliability is thus achieved in a simple manufacturing process.

It is advantageous to join the supporting ring and the fitting by means of contraction of the plastic of the fitting. Such contraction can, for example, occur when a thermoplastic is solidifying, whereby the extent of the contraction depends on the material used.

In a further advantageous development, a material interconnection is made between the plastic of the supporting ring and the plastic of the fitting. Such a material connection can be achieved by means of a melting of the adjoining areas of the plastic of the supporting ring and the plastic of the fitting. It is hereby advantageous when the plastic of the fitting has a lower melting point than that of the plastic of the supporting ring.

In an advantageous development, the supporting ring comprises a profiling which interlocks with a counterprofiling of the fitting. This interlocking can be used instead of or in addition to the frictional connection or the material connection. The profiling and counterprofiling can also be made in a simple way in an injection-molding process, whereby however the component which is first injected must be placed in a second injection mould for the subsequent injecting of the second component.

In an advantageous development the base body is completely formed by the supporting ring, so that the base body is made entirely of plastic.

In another advantageous development the base body comprises the above-mentioned supporting ring and a hub made of metal, preferably aluminum, which is joined to the supporting ring. The metal hub ensures a solid securing to a shaft of the bearing arrangement and thus results in good operational reliability.

It is hereby advantageous to join the supporting ring and the hub by frictional connection.

The joining can be done in an advantageous way by contracting the plastic of the supporting ring.

In an advantageous development the supporting ring and the hub can have a profiling and a counterprofiling, which, in addition to or instead of the described interconnection, facilitate an interlocking connection between the hub and the supporting ring.

In the process of the invention, the ring-shaped fitting and the supporting ring are each made in a separate injection-molding process, whereby the fitting and the supporting ring are joined together in the second injection-molding process.

It is hereby advantageous when the fitting is made in a first injection-molding process and the supporting ring in a second. It is also possible instead to proceed in reverse and to make the supporting ring first and then the fitting.

In an advantageous development, the second injection-molding process follows the first one after such a short time interval that both the fitting and the supporting ring have sufficient temperatures to enable the melting of the two plastics. The component first injected still has a high temperature, which lies just below the flow temperature. The component first injected is heated in the area where it comes into contact with the liquid plastic of the second component when this second component is injected into the mould. This has a particular effect when the flow temperature of the component injected second is higher than the flow temperature of the component injected first. Due to this advantageous process, the plastic of the fitting and the supporting ring are fused together well in the areas where they come into contact.

In an advantageous development the supporting ring and the fitting are made in the same injection mould. This simplifies further the manufacturing process. The injecting of the supporting ring and the fitting can be carried out to advantage when the plastic material for the fitting, heated to a free-flowing temperature, is injected into an injection mould. Then a mould core, with which the inner circumference of the fitting, now a little solidified, comes into contact, is removed in axial direction from the injection mould. The plastic material for the supporting ring, heated to a free-flowing temperature, is injected into the injection mould, whereby the injected material comes into contact with the inner circumference of the fitting, so that the fitting and the supporting ring fuse together by melting.

When the base body is to be provided with a hub, this is then placed in the injection mould. When injecting the supporting ring, the plastic material of same, heated to a free-flowing temperature, is injected onto the outer circumference of the hub, so that a strong connection is made.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
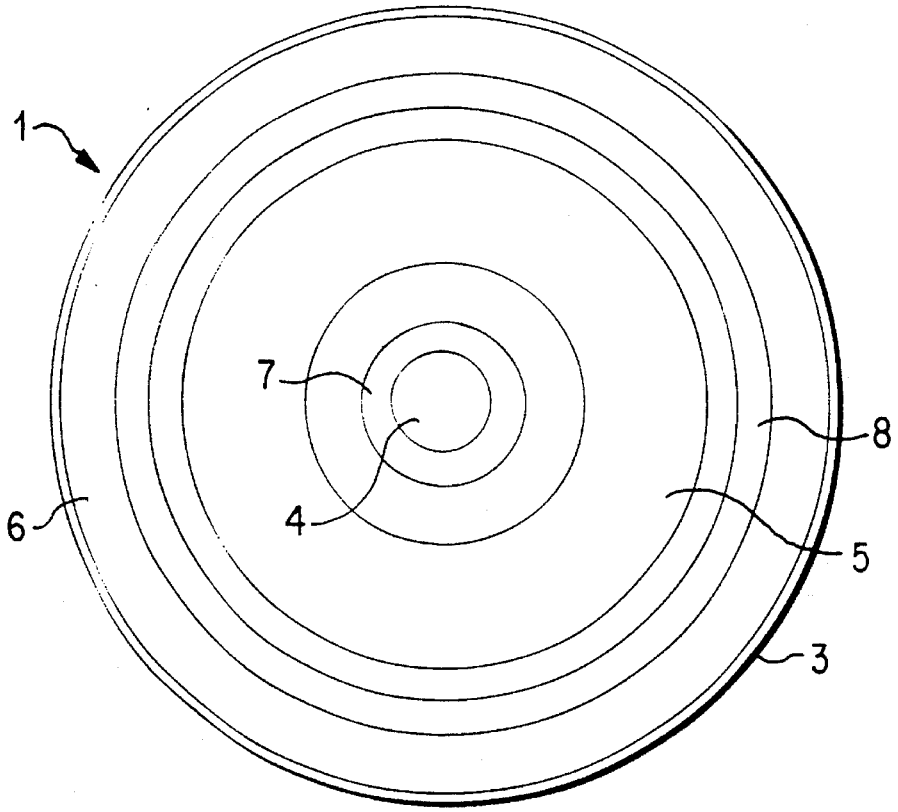
FIG. 1 shows a first embodiment of a supporting disk in front view, constructed according to a preferred embodiment of the present invention.
Figure 2:
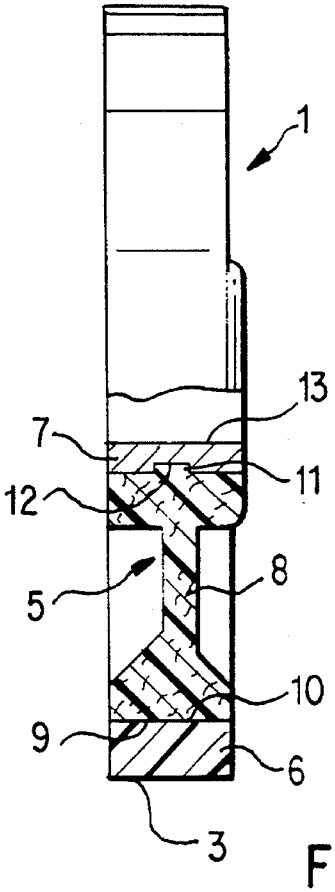
FIG. 2 shows a partial axial section through the supporting disk of FIG. 1.

The supporting disk 1 shown in FIGS. 1 and 2 is a component of a supporting disk bearing arrangement (not shown) for an open-end spinning rotor. The commercially available Suessen Twin Disk bearing is an example of such a supporting disk bearing arrangement. The supporting disk bearing arrangement comprises four such supporting disks 1 altogether, which are arranged with respect to each other in pairs so that two wedge-shaped gaps, positioned opposite each other, are formed to support the shaft of the open-end spinning rotor. The outer circumference 3 of each supporting disk 1 serves hereby as a bearing surface for the shaft of the open-end spinning rotor. Two supporting disks 1 of a supporting disk bearing arrangement are arranged on a common shaft 4.

The supporting disk 1 comprises a base body 5 and a ring-shaped fitting 6. The base body 5 comprises a hub 7 made from aluminum and a supporting ring 8, which is joined to the outer circumference of the hub 7. The fitting 6 is joined to the outer circumference 9 of the supporting ring 8, the outer circumference of the fitting 6 extending slightly conically in a first stage of production, which can be seen clearly in FIG. 2. In a further stage of production the bearing surface will be made cylindrical by grinding. The hub 7 can be pressed onto a shaft 4 (not shown in FIG. 2), so that a fixed connection between the shaft 4 and the supporting disk 1 is made. The inner circumference 13 of the hub 7 lies hereby with frictional connection on the outer circumference of the shaft The supporting ring 8 and the fitting 6 are both made of plastic. For the supporting ring 8 in the embodiment described here, a polyester containing glass fiber with a modulus of elasticity of 16,000 MPa is used, and for the fitting 6, a polyurethane with a modulus of elasticity of 700 MPa is used. Both materials are thermoplastic synthetics.

The outer circumference 9 of the supporting ring 8 is joined to the inner circumference 10 of the fitting 6 by means of fusion of the plastics in this area.

The inner circumference of the supporting ring 8 is provided with a profiling 11 in the form of a circular web, against which a counterprofiling 12, in the form of a groove extending around the outer circumference of the hub 7, interlocks with it. In addition there is a frictional connection between the hub 7 and the fitting 6 brought about by contracting the plastic of the supporting ring 8.

Figure 3:
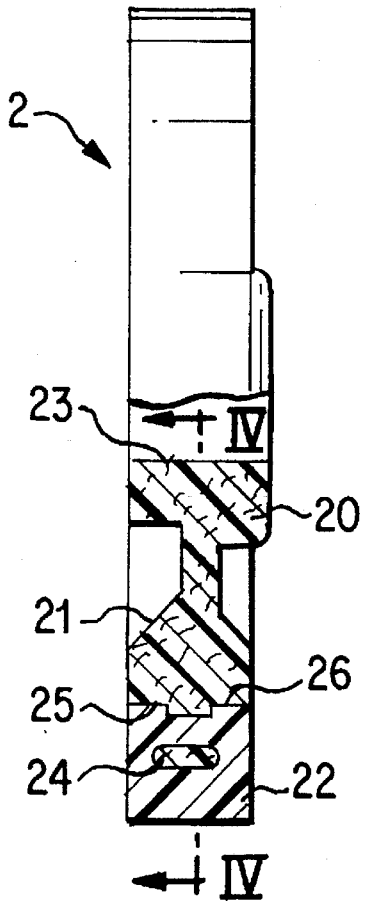
FIG. 3 shows a partial axial section similar to FIG. 3 through another embodiment of a supporting disk.

In the embodiment of a supporting disk 2 shown in FIG. 3, the base body 20 comprises a supporting ring 21 completely made of plastic. This can be pressed onto a shaft (not shown), whereby its inner circumference 23 rests directly against the shaft.

The supporting ring 21 is provided with a profiling 24 which projects from its outer circumference 25 and which has a ring of holes 24A. The ring-shaped fitting 22 is provided with a counterprofiling in the form of a circular or annular recess, which lies interlocked against the profiling 24 of the supporting ring 21. The plastic material of the ring 22 fills out the holes 24A during the molding process. In addition to this positive connection, there is a connection between the outer circumference 25 of the supporting ring 21 and the inner circumference 26 of the fitting 22, brought about by the fusion of the plastics.

An injection mould is used to make the supporting disk 1 shown in FIGS. 1 and 2, into which the whole supporting disk 1 can be injected in consecutive procedures. First, the thermoplastic polyurethane which is used for the fitting 6 and which is heated to a free-flowing temperature is injected in the first procedural step into the injection mould. A mould core is introduced into the injection mould, which then forms the inner circumference 10 of the fitting 6. As soon as the fitting 6 has solidified a little, the form core is then removed in axial direction from the injection mould.

A short while later, the thermoplastic polyester which is used for the supporting ring 8 and which has been heated to a free flowing temperature is injected in the second procedural step into the injection mould. At this point, the hub 7 is also inside the injection mould.

The melting temperature of the polyester is higher than that of the polyurethane. As soon as the injection-molded polyester comes into contact with the polyurethane, the temperature of the polyurethane is increased, so that the two plastics fuse together.

When the polyester is injected into the injection mould, it touches against the outer circumference of the hub 7, whereby the groove-shaped counterprofiling 12 is filled up. An interlocking connection is thus formed. When solidifying, the polyester contracts, so that a positive connection between the supporting ring 8 and the hub 7 is made.

Figure 4:
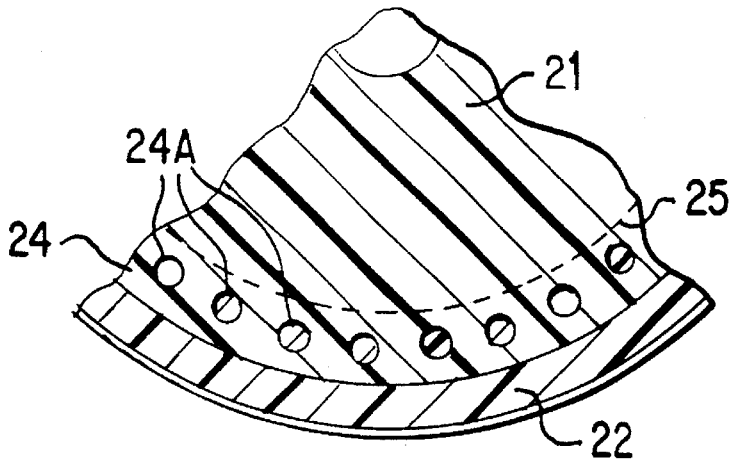
FIG. 4 is a partial sectional view taken along line IV—IV of FIG. 3.

When manufacturing the supporting disk 2 shown in FIGS. 3 and 4, the base body 20, including the profiling 24, is first poured into a mould. The base body 20 is then removed from the mould and put into a second mould, into which the plastic for the fitting 22 is injected and thereby fused with the supporting ring 21.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A supporting disk for a supporting disk bearing arrangement of an open-end spinning rotor, the supporting disk comprising:

a base body, attachable to a shaft and having a supporting ring made of a first thermoplastic material, a ring-shaped fitting made of a second thermoplastic material, the fitting having an outer circumference formed as a bearing surface for a shaft of the open-end spinning rotor and an inner circumference, and a fused connection between an outer circumference of the supporting ring and the inner circumference of the fitting, wherein the first thermoplastic material has a higher melting temperature than the second thermoplastic material, and wherein said supporting ring and fitting are joined along said inner circumference of the fitting by injection molding of said supporting ring inside of said ring shaped fitting with said first thermoplastic material of the supporting ring being hotter than the melting temperature of the second thermoplastic material of the fitting to thereby melt the second thermoplastic material at the inner circumference of the fitting to thereby form the fused connection of the fitting and supporting ring.

2. A supporting disk according to claim 1, wherein the supporting ring comprises a profiling at its outer circumference which interlocks with a counterprofiling of the inner circumference of the fitting.

3. A supporting disk according to claim 2, wherein the base body is made completely of plastic and is integral with the supporting ring.

4. A supporting disk according to claim 2, wherein the modulus of elasticity of the thermal plastic material of the supporting ring is at least ten times that of the modulus of elasticity of the thermal plastic material of the fitting.

5. A supporting disk according to claim 1, wherein the base body is made completely of plastic and is integral with the supporting ring.

6. A supporting disk according to claim 5, wherein the supporting ring comprises a profiling at its outer circumference which interlocks with a counterprofiling of the inner circumference of the fitting.

7. A supporting disk according to claim 5, wherein the modulus of elasticity of the thermal plastic material of the supporting ring is at least ten times that of the modulus of elasticity of the thermal plastic material of the fitting.

8. A supporting disk according to claim 1, wherein the base body comprises a ring-shaped hub made of metal, the outer circumference of the hub being joined to the inner circumference of the supporting ring.

9. A supporting disk according to claim 8, wherein the hub and supporting ring are joined by a frictional connection.

10. A supporting disk according to claim 9, wherein the frictional connection between the hub and the supporting ring is formed by means of contraction of the plastic of the supporting ring.

11. A supporting disk according to claim 3, wherein the modulus of elasticity of the thermal plastic material of the supporting ring is at least ten times that of the modulus of elasticity of the thermal plastic material of the fitting.

12. A supporting disk according to claim 8, wherein the supporting ring has a profiling at its inner circumference, which profiling interlocks with a counterprofiling of the outer circumference of the hub.

13. A supporting disk according to claim 8, wherein the modulus of elasticity of the thermal plastic material of the supporting ring is at least ten times that of the modulus of elasticity of the thermal plastic material of the fitting.

14. A supporting disk according to claim 1, wherein the modulus of elasticity of the thermal plastic material of the supporting ring is at least ten times that of the modulus of elasticity of the thermal plastic material of the fitting.

15. A supporting disk for a supporting disk bearing arrangement of an open-end spinning rotor, the supporting disk comprising:

a base body, attachable to a shaft and having a supporting ring made of a first thermoplastic material, a ring-shaped fitting made of a second thermoplastic material, the fitting having an outer circumference formed as bearing surface for a shaft of the open-end spinning rotor and an inner circumference, and a fused connection between an outer circumference of the supporting ring and the inner circumference of the fitting.

* * * * *